United States Patent [19]

Brennan

[11] 4,241,788

[45] Dec. 30, 1980

[54] MULTIPLE CUP DOWNWELL GAS SEPARATOR

[75] Inventor: John R. Brennan, Long Beach, Calif.

[73] Assignee: Armco Inc., Middletown, Ohio

[21] Appl. No.: 8,183

[22] Filed: Jan. 31, 1979

[51] Int. Cl.[3] ..... E21B 43/38

[52] U.S. Cl. ..... 166/105.5; 166/265; 166/314; 417/313

[58] Field of Search ..... 166/105.5, 357, 105.6, 166/105, 68.5, 265, 314; 417/313; 55/159, 206

[56] References Cited

U.S. PATENT DOCUMENTS

| | | | |
|---|---|---|---|
| 2,104,339 | 1/1938 | Arutunoff | 166/105.5 X |
| 2,229,541 | 1/1941 | Zublin | 166/105.5 |
| 2,346,602 | 4/1944 | O'Bannon | 166/105.5 |
| 2,692,051 | 10/1954 | Webb | 166/265 UX |
| 2,800,085 | 7/1957 | Hansen | 166/105.5 |
| 2,843,053 | 7/1958 | Carle | 166/105.5 X |
| 3,291,057 | 12/1966 | Carle . | |
| 3,624,822 | 11/1971 | Carle et al. . | |
| 3,625,288 | 12/1971 | Roeder | 166/314 |

*Primary Examiner*—Stephen J. Novosad

[57] ABSTRACT

A gas separator for a well pump for pumping well fluid. The gas separator includes a plurality of upwardly opening retention cups which are disposed in vertical spaced relationship one above the other above a reservoir chamber. Each retention cup has a retention chamber which provides a fluid retaining capacity sufficient to momentarily retain well fluid flowing from the well so as to permit gas to escape from the fluid so retained and returned to the well. The difference in specific gravity between gassy well fluid and well fluid with gas removed creases circulation of well fluid through the retention cups and into the reservoir chamber, with each retention cup catching down falling well fluid that has been partially freed of entrained gas. Second stage separation of gas from well fluid is achieved by providing at least one opening or passageway from the reservoir chamber adapted to provide a gas exit between the well and the reservoir chamber.

10 Claims, 5 Drawing Figures

MULTIPLE CUP DOWNWELL GAS SEPARATOR

TECHNICAL FIELD

This invention relates to gas separators and more particularly to gas separators for the separation of gas-liquid mixtures in deep wells.

BACKGROUND ART

Oil occurring in oil reservoirs is associated with varying quantities of water and gas. Both the water and the gas entering the well bore must be produced in order to produce the oil. In the early life of a field, when the reservoir pressure is high and wells are flowing, gas assists in lifting oil efficiently. However, in the later life of a field downwell separation of gas and oil becomes desirable when the well must be pumped.

If there is no separation of gas and oil before the fluid is pumped, the gas must go through the pump. When it does, it uses displacement that would otherwise be utilized for pumping liquid. In extreme situations, excessive quantities of gas cause the pump to "gas lock", and no fluid is displaced. For this reason, it has been found desirable to provide the downwell pump with a gas separator adapted to remove the gaseous substances from the well fluid being pumped to insure efficient and continuous operation of the downwell pump. If an ideal separation of gas and fluid is accomplished, all the gas flows up the annulus between the casing and tubing and enters the gas gathering system or flow line at the casing head. The de-gassed fluid enters the suction of the downwell pump and continues up the tubing, where it enters the production flow line at the well head. The gas separator of the present invention is intended primarily for use with reciprocating or jet type downwell pumps. The reciprocating pumps can be either the sucker rod type, which are powered by reciprocating the sucker rod string, or the hydraulic type, which are powered by high pressure power fluid operating a reciprocating engine and pump downhole. The jet pumps are powered by high pressure water or oil supplying power to a jet eduction system downhole. The invention would not be readily adaptable to a downwell centrifugal (also called a submersible or a submergible) pump since these pumps take their suction approximately in the center of the assembly and the multiple cup separator is for all practical purposes limited to pumps that take their suction at the lower end of the pump assembly.

Most prior art gas separators or anchors have ports in the side, and are more prone to draw in both gas and fluid. Some have had multiple cups, but have had no provision for two stage separation. Additionally, other gas separators are of a specialized design which must be placed between the electric motor, operating at the bottom of a submersible unit, and a centrifugal pump which is located at the top. An example of such a prior art gas separator is disclosed in U.S. Pat. No. 3,291,057, in the name of J. T. Carle. More particularly, the rotating shaft from the motor to the pump must pass through the center of the Carle gas separator. This shaft, together with other components, occupies a considerable amount of the cross section area which decreases the gas-liquid separation. Additionally, such a gas separator connot operate without a rotating source of power available to drive a charging pump and effect a second stage of separation. Accordingly, the art continues to seek improved gas separators which are more efficient and may be used with reciprocating or jet downwell pumps where there is no rotating source of power available to drive the pump and effect a second stage of separation.

DISCLOSURE OF THE INVENTION

The present invention provides an improved gas separator for a downwell pump for pumping well fluid. The separator includes a plurality of upward opening retention cups disposed in vertical spaced relation one above the other. Each of the retention cups forms a retention chamber having a fluid retaining capacity sufficient to momentarily retain well fluid so as to permit gas to escape from the fluid so retained and return to the well. A reservoir chamber is disposed in spaced relation beneath the retention cups. A first passageway is defined adapted to provide fluid communication between the retention cups and the reservoir chamber. A second passageway is defined adapted to provide fluid communication from the reservoir chamber to the pump suction of the downwell pump. Finally, a third passageway provides communication between the interior and exterior of the reservoir chamber to allow gas contained therein to escape therefrom and return to the well.

The gas separator utilizes the difference in specific gravity between gassy well fluid and well fluid with gas removed to create the circulation from the retention cup chambers to the reservoir chamber through the first passageway to provide a surplus of once separated well fluid so that the gaseous portion thereof will be discharged through the third passageway and back into the well fluid, the remainder being twice degassed fluid going to the pump suction of the downwell pump through the second passageway.

In other embodiments the diameter of each of the retention cups is substantially larger than the diameter of the rest of the gas separator. Furthermore, each of the cups is provided with a substantial depth which provides an increased retention time for gas separate from well fluid.

The discharge from each of the retention cups to the first passageway is preferably at the bottom of each of the retention cups and is accomplished by way of at least one port in the first passageway communicating with each retention cup chamber at the bottom of each chamber.

The first and second passageways may be coaxial and the retention cups may surround the first passageway.

DETAILED DESCRIPTION OF THE INVENTION

Figure 1:
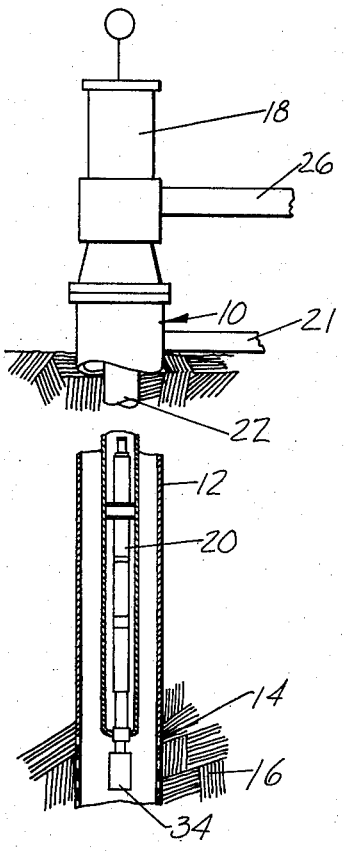
FIG. 1 is a view, partially in vertical section and on a reduced scale, showing a fluid operating pumping system which embodies the multiple cup gas separator of the present invention installed in a well casing.
Figure 2:
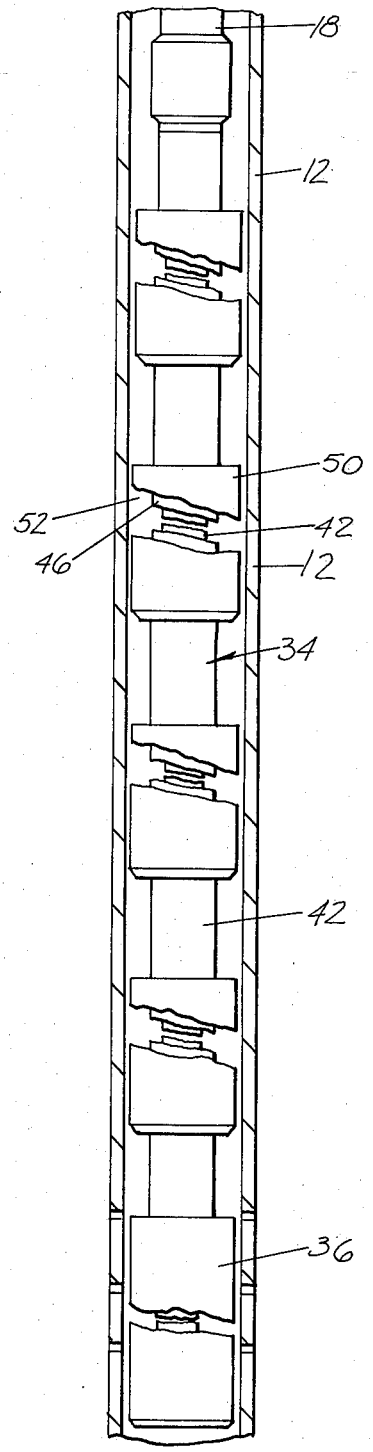
FIG. 2 is a view, partially in section, showing the multiple cup downwell gas separator of the present invention.
Figures 3A, 3B:
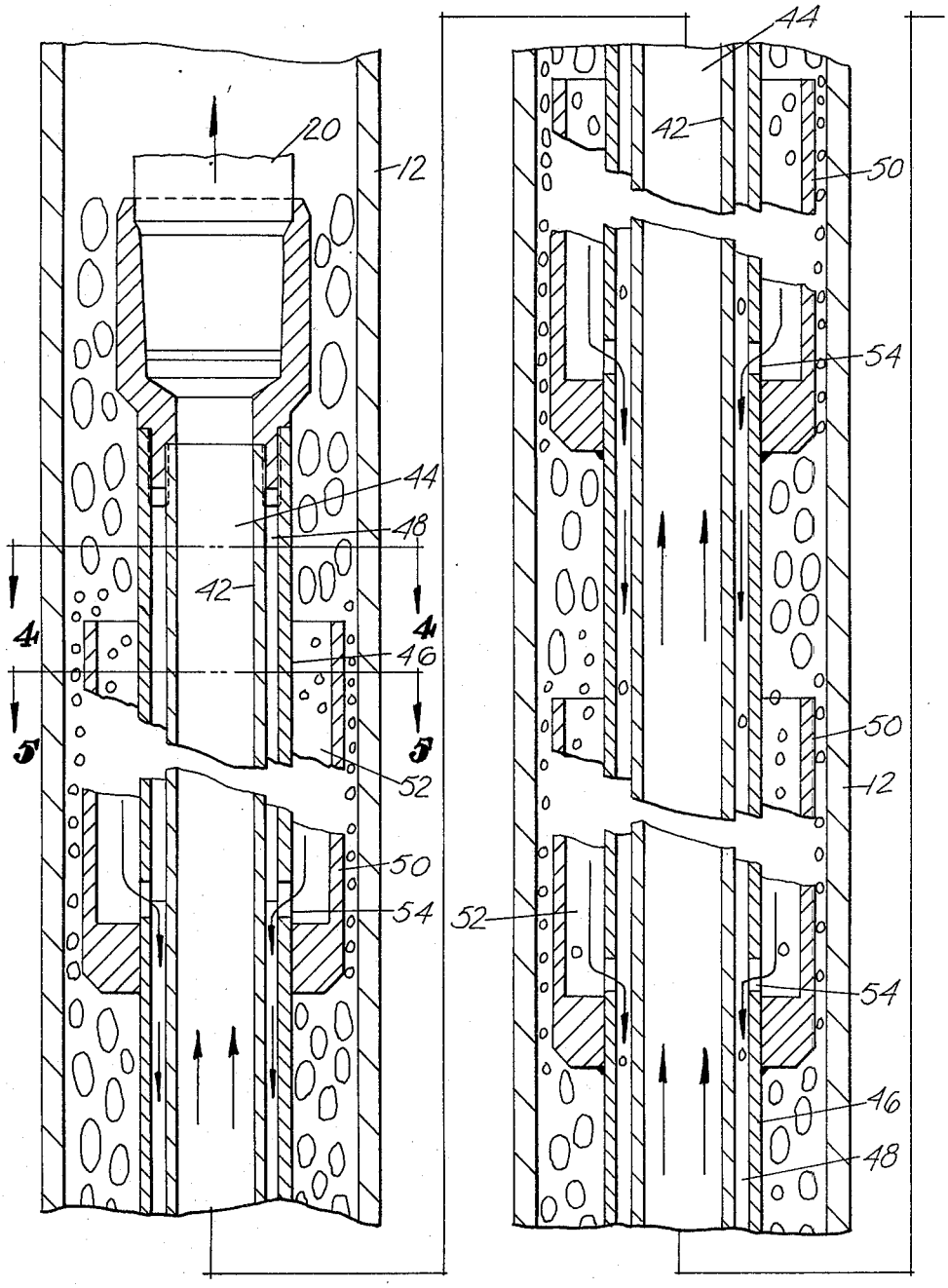
FIGS. 3A–3C is an enlarged cross sectional view through the multiple cup downwell gas separator of FIG. 2 showing schematically the flow of gassy well fluids, removed gas and gas free well fluid.
Figure 3G:
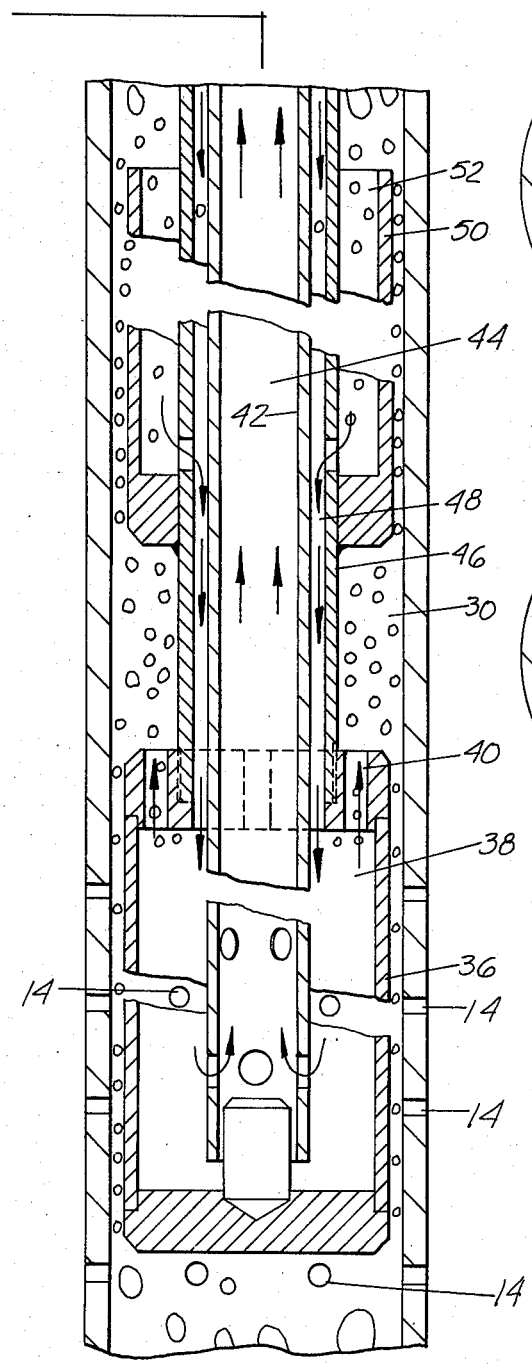
Figure 4H:
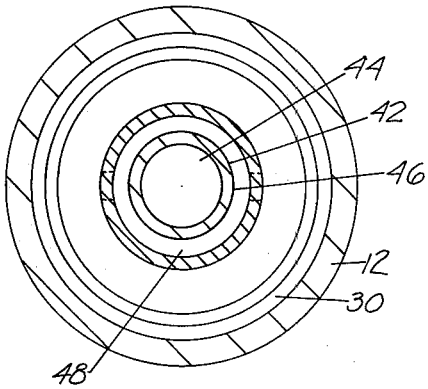
FIG. 4 is a cross sectional view taken on the line 4—4 of FIG. 3A.
Figure 5:
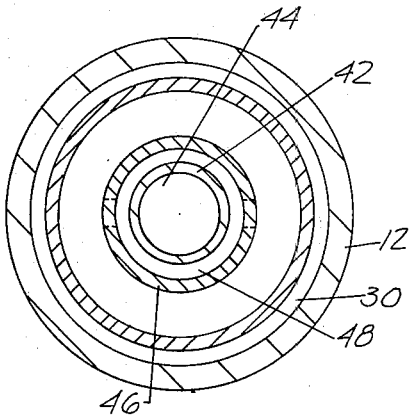
FIG. 5 is a cross sectional view taken on the line 5—5 of FIG. 3A.

Referring to the drawings, FIG. 1 shows a typical well 10 having a casing 12 set therein, the casing 12 having perforations 14 adapted to register with a producing well stratum 16. Production tubing 22 extends downwardly from the well head 18 into the well 10. The inlet of the downwell pump 20 extends downwardly and the multiple gas separator 34 of the present invention is attached thereto.

As has been previously indicated herein in discussing the background art, down-well separation of gas and oil becomes desirable when the well must be pumped. If there is no separation the gas must go through the downwell pump 20, taking up displacement that would otherwise be utilized for oil. If an ideal separation of gas and fluid could be accomplished, all of the gas would flow up the annulus between the casing and tubing and would enter a gas gathering system or flow line 21 at well head 18. The de-gassed fluid would enter the suction of the downwell pump 20 and be produced up the tubing. It would then enter the production flow line 26 at the well head 18.

Actual separation of the gas from the well fluid is accomplished by gravity. Bubbles will rise through the oil at a rate dependent principally on the viscosity of the oil. To separate gas and the oil, it is necessary to cause the oil to flow downward through the gas separator at a rate less than the rate of rise of the bubbles.

The present invention provides a multiple cup gas separator 34. The gas separator 34 includes a housing 36 defining a reservoir chamber 38 adapted for disposition in the well 10 in operative association with the downwell pump 20.

Suitable tubing 42 defines a passageway 44 adapted to provide fluid communication from the reservoir chamber 38 to the suction of the downwell pump 20. Similarly, suitable tubing 46 defines a passageway 48 adapted to provide fluid communication between the well 30 and the reservoir chamber 38. The tubing 46 also provides communication with the annulus between the well casing 12 and the production tubing 22 so that the gas separated from the well fluid enters a gas gathering system (not shown) or flow line 21 at the well head 18. The tubing 42 and 46 may be coaxial, in which case the passageway 44 is defined by the central passageway and the passageway 48 is defined by the annular space surrounding the tubing 42 between the tubing 42 and the tubing 46.

The gas separator 34 includes a plurality of upward opening retention cups 50 disposed in vertical spaced relation one above the other above the reservoir chamber 38. Each retention cup 50 forms a retention chamber 52 and provides fluid and gas communication between the retention chamber 52 and the well 30 and between the retention chamber 52 and the passageway 48. The retention chambers 52 have a fluid retaining capacity sufficient to momentarily retain well fluid flowing from the well 30 to the reservoir chamber 38 through the passageway 48 so as to permit gas to escape from the well fluid so retained and be returned to the well 30 for direction to the gas gathering system or flow line 21 at the casing head. It will be seen that each retention cup 50 is provided with a substantial depth so as to provide retention time for gas to separate from well fluid.

Each of the retention cups 50 preferably surrounds the tubing 46, and the discharge from the retention chamber 52 of each retention cup 50 to the passageway 48 is provided at the bottom of each retention cup 50. In practice this is accomplished by way of the ports 54 in the tubing 46 at the bottom of the retention chambers 52 in the retention 50.

A second stage separation of gas and liquid is achieved by providing at least one opening or passageway 40 in the housing 36 adopted to provide a gas exit between the reservoir chamber 38 and the well 30.

In operation, the multiple cup gas separator 34 is positioned above or opposite the well perforations 14. Well fluid then flows from the well stratum 16 through the perforations 14 in the casing 12 into the well 30, and flows therefrom through the gas separator 34 into the passageway 44 leading to the suction of the downwell pump 20. The gas separator 34 utilizes the difference in specific gravity between gassy well fluid and well fluid with gas removed to create circulation through the retention chambers 52 of the retention cups 50 and to the reservoir chamber 38 through the passageway 48 to provide substantially gas free well fluid in the reservoir chamber 38, with each retention cup 50 catching down falling well fluid that has already been partially freed of entrained gas. The well fluid with the gas removed proceeds from the reservoir chamber 38 through the passageway 44 to the suction of the downwell pump 20. The gas bubbles removed from the well fluid flow up the annulus between the casing and tubing and enter a gas gathering system or flow line at the well head 18.

A second stage separation of gas and liquid is achieved by the openings or passageways 40 in the gas separator housing 36 which are adapted to provide communication between the interior and exterior of the reservoir chamber 38 to allow gas contained therein to escape therefrom and return to the well 30.

The multiple cup gas separator 34 of present invention provides a high capacity gas separator that utilizes multiple retention cups 50 to separate gas from produced fluid. The downward velocity of fluid in the retention chambers 52 of the retention cups 50 can be low by taking suction through any desired number of cups 50. The ports 54 in the tubing 46 distribute flow to withdraw approximately the same amount of fluid from each retention chamber 52 in each cup 50. The efficiency of the gas separator 34 rises as additional retention cups 50 are added thereto.

It will also be noted that the diameter of each of the retention cups 50 will normally be substantially larger than the outside diameter of the tubing 46. However, the diameter of the cups 50 should not be so large as to create excessive upward velocity in the annulus between a cup 50 and the casing 12. Furthermore, the cups 50 of the gas separator 34 provide an appreciable depth and thus an increased retention time for gas to separate from the fluid. Finally, the gas separator 34 of the present invention utilizes differential gradients to create circulation with a surplus of fluid flowing from the multiple retention chambers 52 to the reservoir chamber 38 and a second stage of gas separation occurring as any retained gas is purged from the reservoir chamber 38 out the ports or passageways 40 to the casing annulus of the well 30.

While certain preferred embodiments of the invention have been specifically illustrated and described, it is understood that the invention is not limited thereto, as many variations will be apparent to those skilled in the art, and the invention is to be given its broadest interpretation within the terms of the following claims.

What we claim is:

1. In a gas separator for a downwell pump for pumping well fluid;

(a) a plurality of upward opening retention cups disposed in vertical spaced relation one above the other, the diameter of each said retention cup being substantially larger than the diameter of the rest of said gas separator, each said retention cup forming a retention chamber having a fluid retaining capacity sufficient to momentarily retain well fluid so as to permit gas to escape from said fluid so retained and returned to said well;

(b) means defining a reservoir chamber disposed in spaced relation beneath said retention cups;

(c) means defining a first passageway adapted to provide fluid communication between said retention cups and said reservoir chamber;

(d) means defining a second passagway adapted to provide fluid communication from said reservoir chamber to the pump suction of said downwell pump; and (e) means defining a third passageway providing communication between the interior and exterior of said reservoir chamber to allow gas contained thereto to escape therefrom and return to said well;

whereby said gas separator utilizes the difference in specific gravity between gassy well fluid and well fluid with gas removed to create circulation from said retention cup chambers to said reservoir chamber through said first passageway to provide a surplus of once separated well fluid so that the gaseous portion thereof will be discharged through said third passageway and back into said well fluid, the remainder being twice degassed fluid going to the pump suction of said downwell pump through said second passageway.

2. The gas separator according to claim 1, wherein each said retention cup is provided with a substantial depth providing an increased retention time for gas to separate from well fluid.

3. The gas separator according to claim 1, wherein discharge from each said retention cup to said first passageway is at the bottom of each said retention cup.

4. The gas separator according to claim 3, wherein at least one port is provided in said first passageway communicating with each said retention cup chamber at the bottom of each said retention cup chamber.

5. The gas separator according to claim 1, wherein said first and second passageways are coaxial and said retention cups surround said first passageway.

6. A gas-oil separator for a producing well adapted to be positioned in operative association with a downwell pump, comprising:

(a) a plurality of upward opening retention cups disposed in vertical spaced relation one above the other, the diameter of each said retention cup being substantially larger than the diameter of the rest of said gas-oil separator, each said retention cup forming a retention chamber having a fluid retaining capacity sufficient to momentarily retain well fluid so as to permit gas to escape from said fluid so retained and return to said well;

(b) means defining a reservoir chamber disposed in spaced relation beneath said retention cups;

(c) means defining a first passageway adapted to provide fluid communication between said retention cups and said reservoir chamber;

(d) means defining a second passageway adapted to provide fluid communication from said reservoir chamber to the pump suction or said downwell pump; and (e) means defining a third passageway providing communication between the interior and exterior of said reservoir chamber to allow gas contained thereto to escape therefrom and return to said well;

whereby said gas separator utilizes the difference in specific gravity between gassy well fluid and well fluid with gas removed to create circulation from said retention cup chambers to said reservoir chamber through said first passageway to provide a surplus of once separated well fluid so that the gaseous portion thereof will be discharged through said third passageway and back into said well fluid, the remainder being twice degassed fluid going to the pump suction of said downwell pump through said second passageway.

7. The gas-oil separator according to claim 6, wherein each said retention cup is provided with a substantial depth providing an increased retention time for gas to separator from well fluid.

8. The gas-oil separator according to claim 6, wherein discharge from each said retention cup to said first passageways at the bottom of each said retention cup.

9. The gas-oil separator according to claim 8, wherein at least one port is provided in said first passageway communicating with each said retention cup chamber at the bottom of each said retention cup chamber.

10. The gas-oil separator according to claim 6, wherein said first and second passageways are coaxial and said retention cups surround said first passageway.

* * * * *